US011121462B2

(12) United States Patent
Palreddy

(10) Patent No.: US 11,121,462 B2
(45) Date of Patent: Sep. 14, 2021

(54) PASSIVE ELECTRONICALLY SCANNED ARRAY (PESA)

(71) Applicant: ANTENNA RESEARCH ASSOCIATES, Beltsville, MD (US)

(72) Inventor: Sandeep Palreddy, Springfield, MA (US)

(73) Assignee: ANTENNA RESEARCH ASSOCIATES, Beltsville, MD (US)

( * ) Notice: Subject to any disclaimer, the term of this patent is extended or adjusted under 35 U.S.C. 154(b) by 0 days.

(21) Appl. No.: 16/281,216

(22) Filed: Feb. 21, 2019

(65) Prior Publication Data

US 2019/0288390 A1 Sep. 19, 2019

Related U.S. Application Data

(60) Provisional application No. 62/633,215, filed on Feb. 21, 2018.

(51) Int. Cl.

| | |
|---|---|
| ***H01Q 3/24*** | (2006.01) |
| ***H01Q 21/22*** | (2006.01) |
| ***H01Q 21/06*** | (2006.01) |
| ***H01Q 15/06*** | (2006.01) |
| ***H01Q 1/28*** | (2006.01) |

(52) U.S. Cl.

CPC ..... *H01Q 3/247* (2013.01); *H01Q 1/288* (2013.01); *H01Q 15/06* (2013.01); *H01Q 21/061* (2013.01); *H01Q 21/22* (2013.01)

(58) Field of Classification Search

CPC .. H01Q 3/24; H01Q 3/26; H01Q 3/46; H01Q 3/2676; H01Q 21/22; H01Q 25/008

USPC ..... 343/753, 754; 342/372, 376

See application file for complete search history.

(56) References Cited

U.S. PATENT DOCUMENTS

| | | | | |
|---|---|---|---|---|
| 4,845,507 | A * | 7/1989 | Archer | H01Q 25/008 343/754 |
| 6,130,653 | A * | 10/2000 | Powers, Jr. | H01Q 15/02 343/909 |
| 6,160,519 | A * | 12/2000 | Hemmi | H01Q 3/26 343/753 |
| 6,542,119 | B2 * | 4/2003 | Howell | G01S 19/36 342/357.31 |
| 9,620,865 | B2 * | 4/2017 | Nagaishi | H01Q 3/40 |
| 10,714,836 | B1 * | 7/2020 | Karabacak | H01Q 15/04 |
| 2002/0036587 | A1 * | 3/2002 | Martin | H01Q 3/2658 342/375 |
| 2016/0049924 | A1 * | 2/2016 | Broyde | H01Q 21/0006 343/745 |
| 2018/0081049 | A1 * | 3/2018 | Christie | H01Q 3/40 |
| 2018/0269576 | A1 * | 9/2018 | Scarborough | H01Q 3/245 |
| 2019/0173500 | A1 * | 6/2019 | Artemenko | H01Q 1/247 |

* cited by examiner

*Primary Examiner* — Tung X Le

(74) *Attorney, Agent, or Firm* — Sughrue Mion, PLLC

(57) ABSTRACT

A passive electronically scanned array in a number of phases. Initially, the array system configuration is determined followed by sizing the array, designing, building, and testing a 1D lens, and designing, building, and testing a 1×N switch network. This is followed by building and testing the array with associated 1D lenses, and integrating and testing switch networks connected to each lens in array. This is followed by design, build, test, and integration of the orthogonal switch matrix that connects to all of the lens switch matrixes, and system integration.

8 Claims, 8 Drawing Sheets

PASSIVE ELECTRONICALLY SCANNED ARRAY (PESA)

CROSS-REFERENCE TO RELATED APPLICATION

This patent application claims priority to U.S. Provisional Patent Application No. 62/633,215, filed on Feb. 21, 2018, which is hereby incorporated by reference in its entirety.

BACKGROUND

It is desired to have an antenna array where the beam created by the array can be scanned electronically. The advantages of electrical scanning versus mechanical scanning, include mechanical simplicity and its associated increase in reliability, agile beam scanning, and quick beam scanning. To utilize a phased array antenna implies that the amplitude and phase distribution be controlled. In order to scan the beam in real time, the phase distribution on the antenna array must be controllable in real time.

A conceptually straight forward related art approach to controlling the array phase distribution is to use a phase shifter for each antenna element in the array as part of the corporate feed network that feeds each element. While simple in concept, when the details are examined such arrays are not easy to fabricate and get the desired performance. They also are expensive. Some of the technical problems associated with this approach are loss, power distribution, and control signal distribution. The loss can mostly be overcome by using amplifiers in addition to phase shifters. This has the added complications of more power distribution being required and then additional heat generated that must be removed.

Another related art approach for controlling the phase and amplitude distribution is to space feed the array. In this approach, an excitation signal is radiated and picked up by the elements on the space feed side of the array and then the phase is adjusted before the signal is radiated. This removes a lot of the corporate feed network and its associated loss, but it still requires phase shifters and has the associated problems given above.

Yet another approach is to use a lens. This could be a 3D lens with different ports that are switched on to steer the beam in various directions. It is also possible to break the lens down into several 1D implementations that can be put together to steer the beam in all the desired directions. This is done because it is less complex and perhaps more compact than a 3D lens design.

SUMMARY

The disclosed teachings provide a passive electronically scanned array in a number of phases. Initially, the array system configuration is determined followed by sizing the array, designing, building, and testing a 1D lens, and designing, building, and testing a 1×N switch network. This is followed by building and testing the array with associated 1D lenses, and integrating and testing switch networks connected to each lens in array. This is followed by design, build, test, and integration of the orthogonal switch matrix that connects to all of the lens switch matrixes, and system integration.

To realize some of the advantages of the disclosed teachings, there is provided a passive phased array antenna comprising a first plurality of M bootlace lenses parallel to each other, a second bootlace lens orthogonal to said plurality of the first plurality of M bootlace lenses, M array of N antenna elements each N of said M arrays feeding to a separate one of said M bootlace lenses and M 1×N RF switches, each of said M switches is connected to and scan a separate one of said first plurality of said M bootlace lenses. The outputs from the M switches are fed to the second bootlace lens. A 1×M RF switch is connected to and scans the second bootlace lens. An output from the 1×M switch feed a satellite communication system.

Specifically, at least one of the bootlace lenses is a Rotman lens.

Specifically, at least one of the bootlace lenses is optimized using 3D electromagnetic analyses.

In yet another specific enhancement at least one of the switches is a low loss absorptive switch.

In yet another specific enhancement at least one of the switches is a PIN diode switch.

In yet another specific enhancement at least one of the switches is a MEMS switch.

In still another specific enhancement, at least one of the switches is a ferrite based RF switch.

A passive electronically scanned array can be used anywhere it is desired to have an electronically scanned antenna array. Some example applications include, SatCom on the Move, and tracking and utilizing non-geosynchronous satellites.

BRIEF DESCRIPTION OF THE DRAWINGS

The above objectives and advantages of the disclosed teachings will become more apparent by describing in detail preferred embodiments thereof with reference to the attached drawings in which.

DETAILED DESCRIPTION

Figure 1:
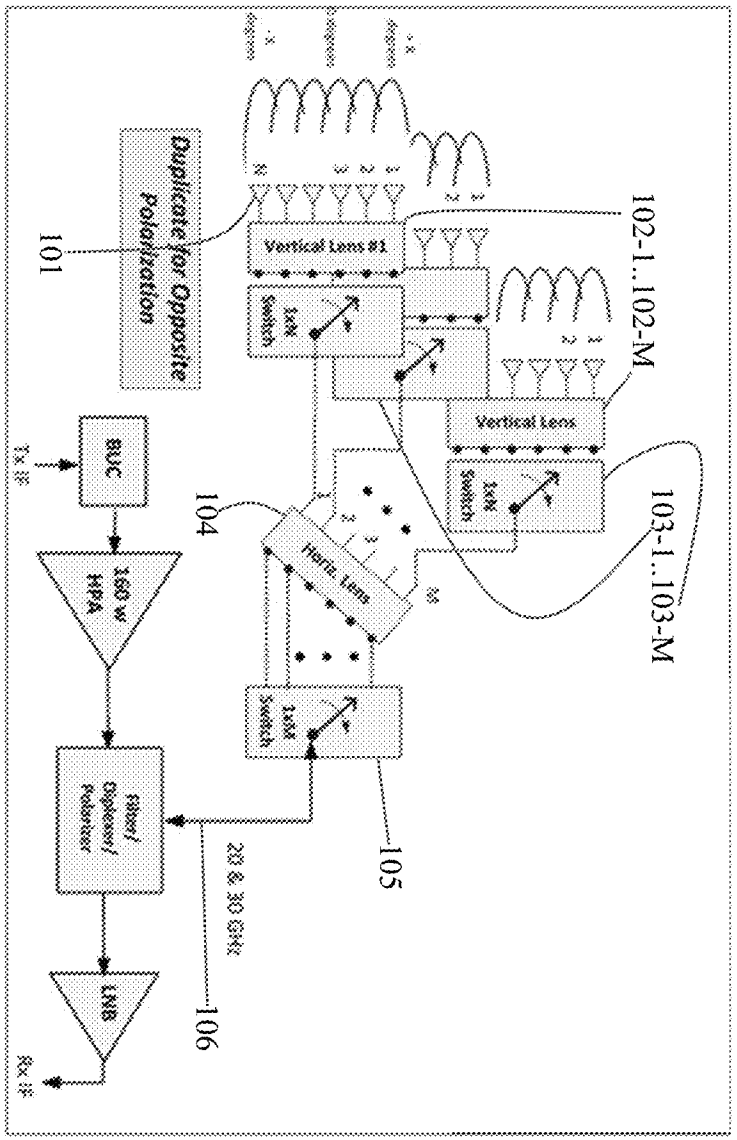
FIG. 1 shows an embodiment of a 1D Phased Array Antenna Solution according to the disclosed teachings.

An embodiment of the disclosed teachings is shown in FIG. 1. In this embodiment a 1D lens approach is used to create a phased array antenna. Specifically a bootlace style 1D lenses. At a minimum, a set of bootlace lenses is required for each row or column of the array (102-1 through 102-M). This set of lenses is fed by an orthogonal bootlace lens (104). For purposes of this paper the lenses next to the array are called vertical lenses (102-1 through 102-M) and the lens orthogonal to it is horizontal (104). This is arbitrary, the array could be fabricated with sets of horizontal lenses directly behind the array with a "vertical" lens to combine their outputs.

M 1×N RF switches (103-1 through 103-M) are provided. Each of the M switches are connected to and scan a separate one of said first plurality of said M bootlace lenses. The outputs from the M switches are fed to the second bootlace lens (104). A 1×M RF switch (105) is connected to and scans the second bootlace lens 104. The output from the 1×M switch (105) feed a satellite communication system (106).

One of the advantages of a bootlace style lens is that it achieves scanning by true time delay. This means the beam will not move as the frequency changes. Multiple frequencies can be used on the same port at the same time.

A bootlace lens can also be used to provide multiple independent simultaneous beams by utilizing different beam ports at the same time. To provide multiple simultaneous polarizations in this application would require two complete sets of orthogonal lenses.

Design Details

Array Sizing

The antenna array is sized based upon the requirements, such as gain, side lobe level, and scan volume. Losses within the antenna system will affect gain and must be accounted for in sizing the array and minimized as much as possible during the design phase of all the individual components.

Bootlace Style Lens

A Rotman lens is a bootlace style lens. The Rotman lens geometry is constrained to provide ease of mechanical scanning by locating the beam ports on an arc. Along with the Rotman Lens, other lens shapes can also be used to get the best performance possible.

Bootlace lenses were originally designed using a parallel plate transmission region between the beam ports and the lens ports. Other designs have used stripline or microstrip transmission regions between the beam ports and lens ports. The lens is envisioned as being printed on a substrate. Part of the design task will be to determine which substrate to use for a particular application. Minimizing the loss in this substrate material is required to meet system performance requirements.

The initial bootlace lens design can be achieved with optical or ray tracing approaches. To get the most performance capability out of the lens, 3D electromagnetic analysis will be utilized to optimize the lens and its associated beam ports and lens ports. Lens can be implements in a PCB board (for low power handling) or waveguide (high power handling) technologies.

Switch Network

The lens architecture requires the use of low loss absorptive switches. Typically, if using active devices for switching, PIN diodes have the lowest loss and the ability to handle higher power. However, at frequencies near 30 GHz PIN diodes are not that low loss. Microelectromechanical systems (MEMS) switches will be investigated as a possible switching solution, and for high power handling requirements ferrite based waveguide switches can be used.

Figure 2:
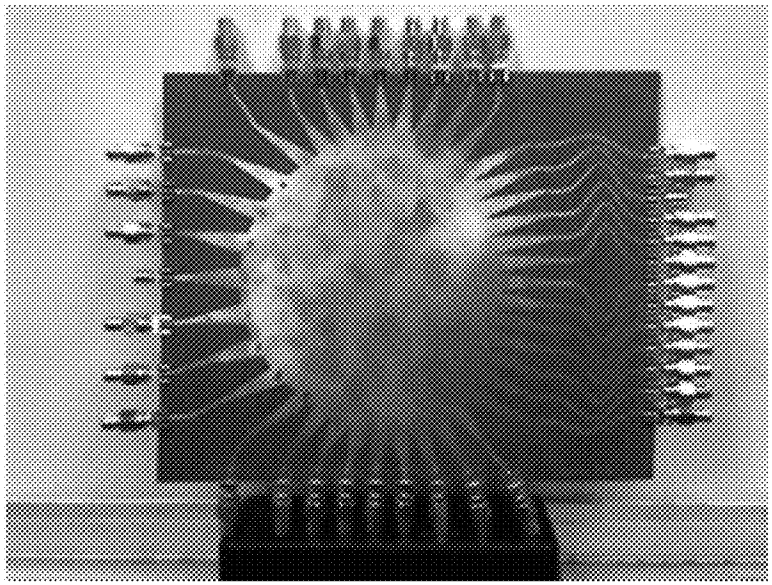
FIG. 2 shows and Broadband Rotman lens that scans ±45° in one plane as per an embodiment of the disclosed teachings
Figure 3:
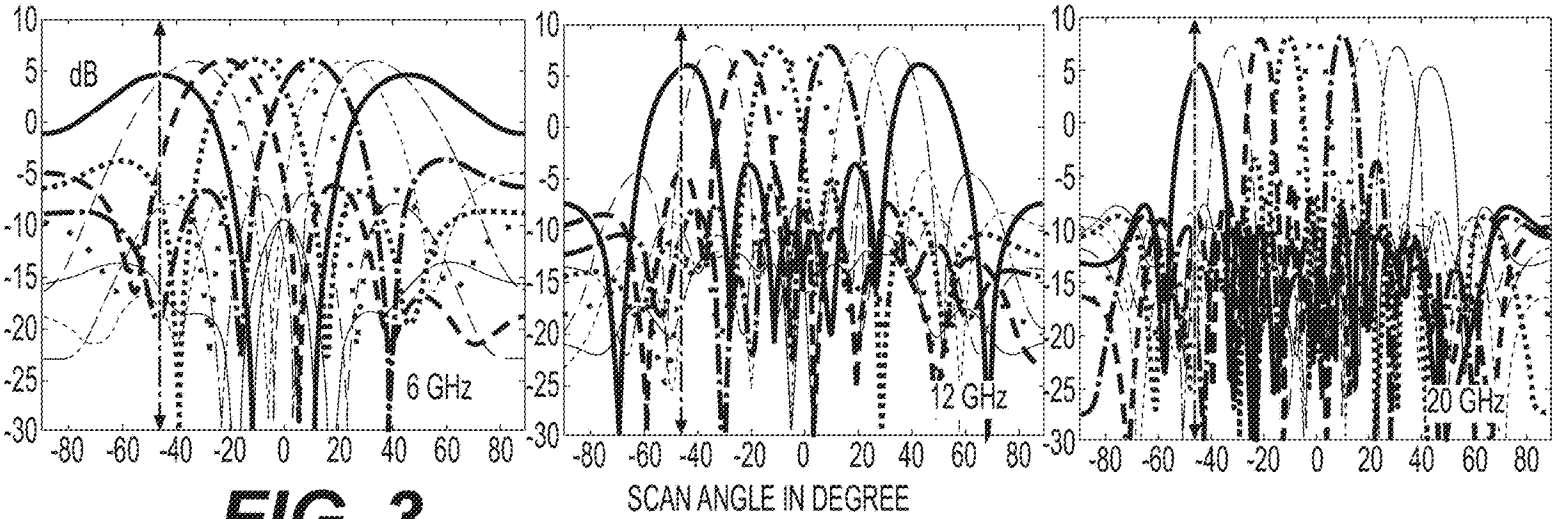
FIG. 3 shows a Radiation performance at 6 to 20 GHz.
Figure 4A:
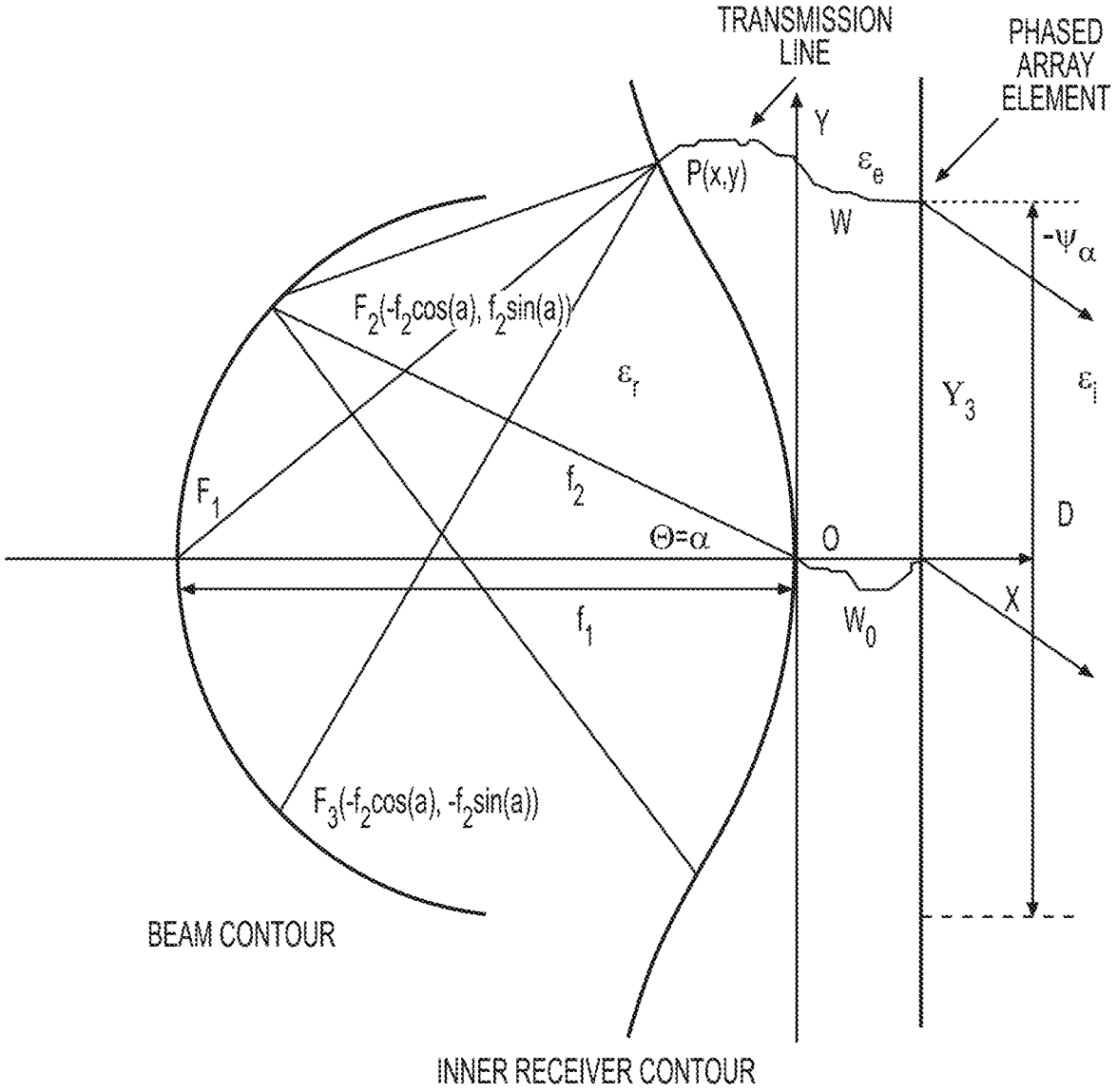
FIG. 4A shows an embodiment of Phase Centers.
Figure 4B:
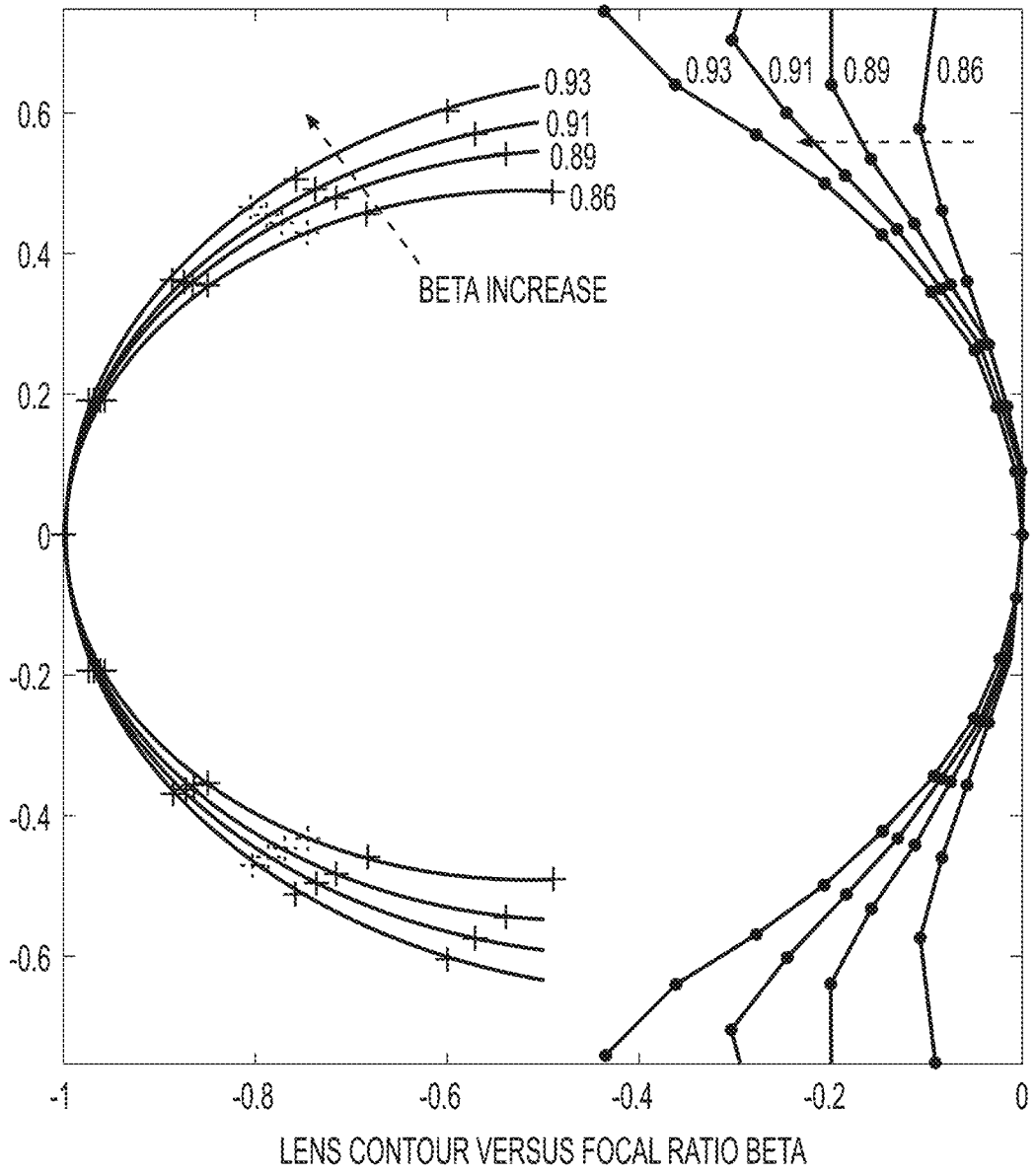
FIG. 4B shows and embodiment of Phase Error Minimization.
Figure 4C:
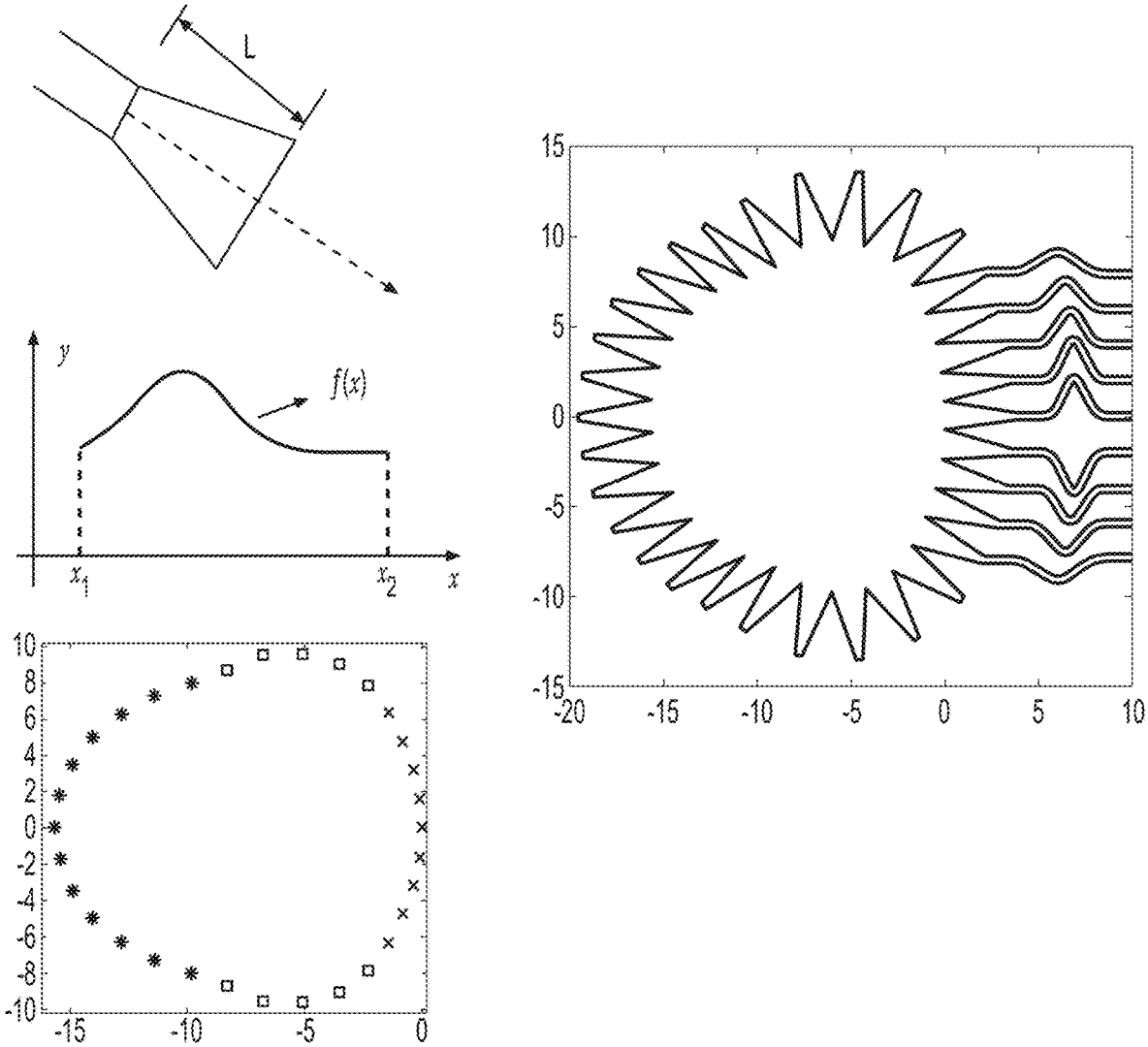
FIG. 4C shows an embodiment of Port Design, T implementation.
Figure 4D:
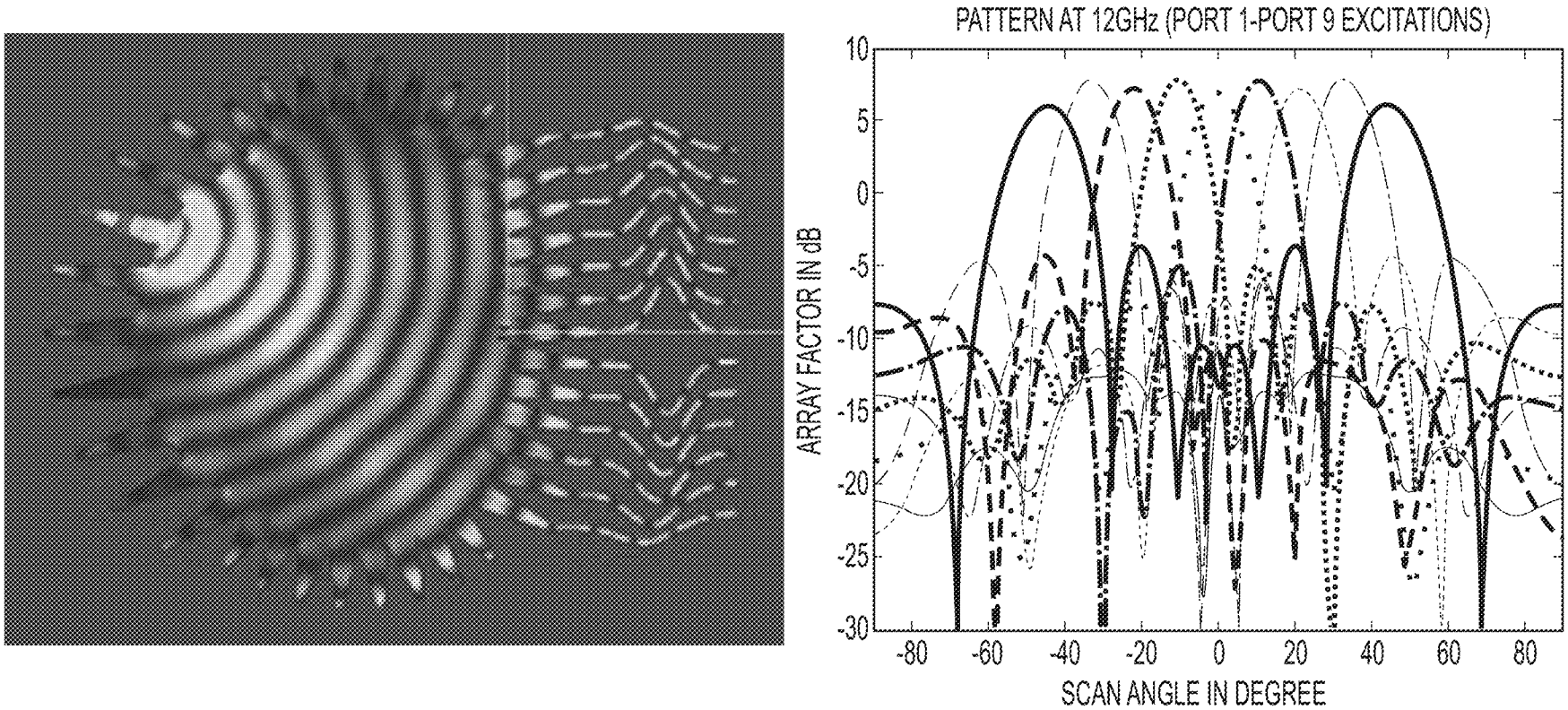
FIG. 4D shows an embodiment of Full Wave Simulation.
Figure 4E:
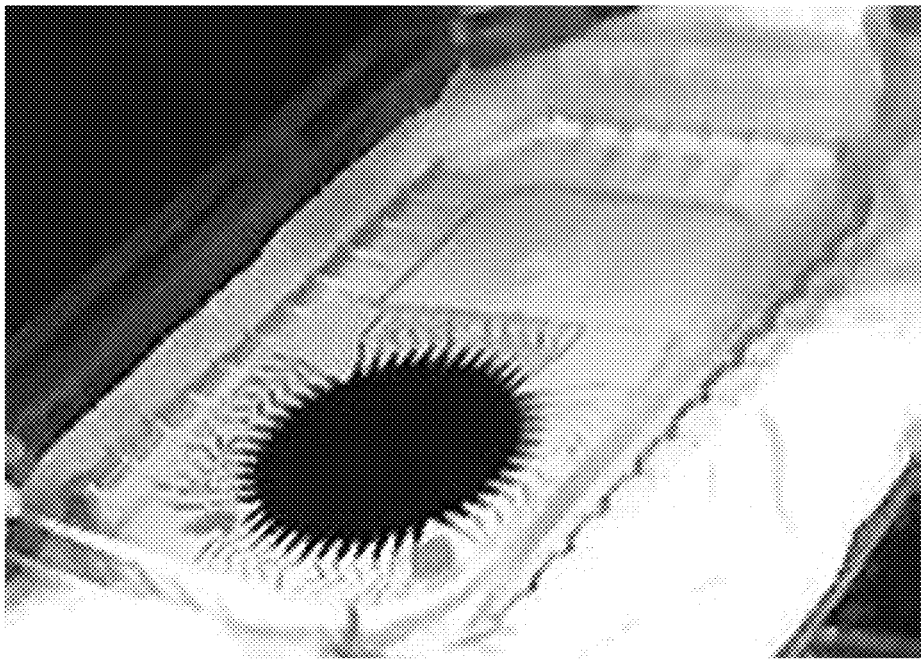
FIG. 4E shows an embodiment of Fabrication.
Figure 5:
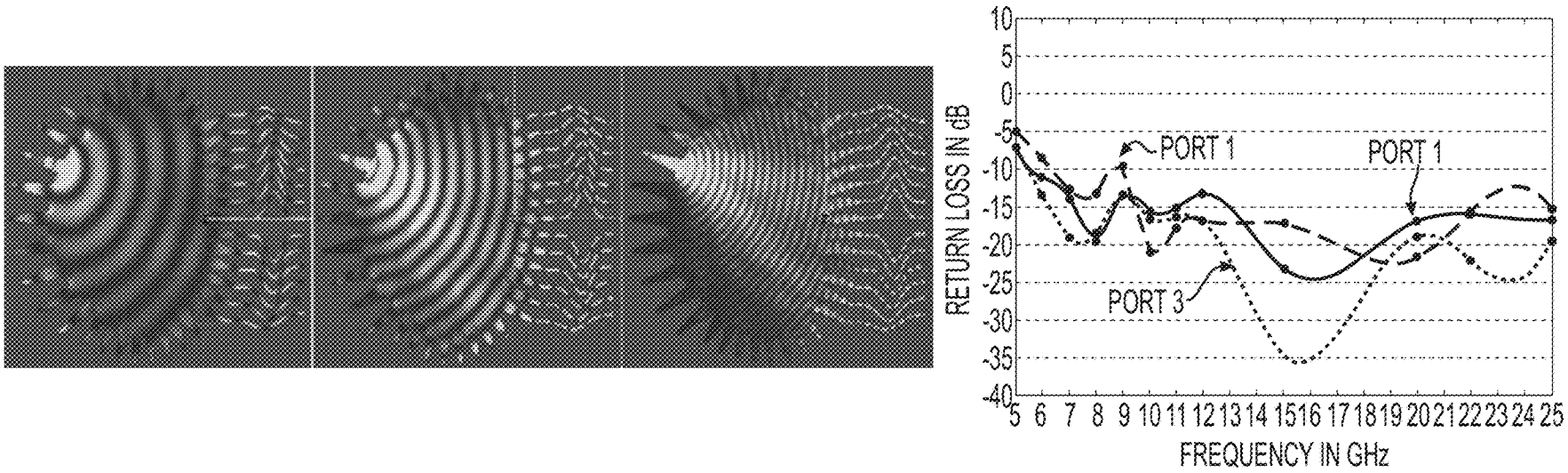
FIG. 5 shows various Rotman Lens Designs from 6 to 25 GHz.

FIG. 2 shows an embodiment of a broadband Rotman lens in one plane. FIG. 3 shows a radiation performance from 6 to 20 GHz. FIGS. 4A-4E show various steps in the design process. As shown in FIG. 4A a beam contour (input side) and receiver contour (output side) are designed to achieve the beam steering angles needed. As a next step, as shown in FIG. 4B both the contours are optimized to minimize the phase error from all the input ports to the output ports. After that, as shown in FIG. 4C, ports in both the input and output sides are transformed to 50 ohms impedance, while not creating any additional phase errors, meaning equal length lines are added to the output ports to transform to 50 ohm impedance. Next, as shown in FIG. 4D, A full wave 3D EM analysis is performed to make sure the performance of the lens is what it should be, any further optimization needed will be done at this stage. Then as shown in FIG. 4E, fabrication is done on PCB board. Fabrication can also be done in waveguide if need be, based on application. Finally, FIG. 2 shows an as-built model on a PCB board (Rogers 5880 shown in picture) with all the input, output & dummy ports.

Although the invention has been described with reference to the disclosed embodiments, those skilled in the art will readily appreciate that the specific examples and studies detailed above are only illustrative of the invention. It should be understood that various modifications can be made without departing from the spirit of the invention. Accordingly, the invention is limited only by the following claims.

What is claimed is:

1. A passive phased array antenna comprising:

a first plurality of M bootlace lenses parallel to each other;

a second bootlace lens orthogonal to said plurality of the first plurality of M bootlace lenses;

M array of N antenna elements each N of said M arrays feeding to a separate one of said M bootlace lenses, where M and N are positive integers;

M 1×O RF switches, each of said M switches connected to and scanning a separate one of said first plurality of said M bootlace lenses;

outputs from the M switches being fed to the second bootlace lens;

a 1×P RF switch connected to and scanning the second bootlace lens; and an output from the 1×P switch feed a satellite communication system, where O and P are positive integers.

2. The antenna of claim 1, wherein at least one of the bootlace lenses is a Rotman lens.

3. The antenna of claim 1, wherein at least one of the Rotman lenses is optimized using 3D electromagnetic analyses.

4. The antenna of claim 1, wherein at least one of the switches is a low loss absorptive switch.

5. The antenna of claim 1, wherein at least one of the switches is a PIN diode switch.

6. The antenna of claim 1, wherein at least one of the switches is a MEMS switch.

7. The antenna of claim 1, wherein at least one of the switches is a ferrite based RF switch.

8. The antenna of claim 1, wherein O=N and P=M.

* * * * *